United States Patent [19]

Watanabe

[11] 4,139,657

[45] Feb. 13, 1979

[54] PROCESS FOR PRODUCING COLOR TELEVISION PICTURE TUBE

[75] Inventor: Naomitsu Watanabe, Mobara, Japan

[73] Assignee: Hitachi, Ltd., Japan

[21] Appl. No.: 771,243

[22] Filed: Feb. 23, 1977

[30] Foreign Application Priority Data

May 10, 1976 [JP] Japan ..... 51-52213

[51] Int. Cl.[2] ..... B05D 5/06; H01J 31/20; H01J 29/22

[52] U.S. Cl. ..... 427/68; 96/36.1; 252/301.36; 427/64; 427/69; 427/123; 427/226

[58] Field of Search ..... 427/64, 68, 123, 226, 427/69; 96/36.1; 252/301.36

[56] References Cited

U.S. PATENT DOCUMENTS

| | | | |
|---|---|---|---|
| 3,317,337 | 5/1967 | Saulnier | 427/68 |
| 3,574,663 | 4/1971 | Schniepp | 427/68 |
| 3,582,389 | 6/1971 | Saulnier | 427/68 |
| 3,582,390 | 6/1971 | Saulnier | 427/68 |
| 3,776,754 | 12/1973 | Levinos | 427/68 |
| 3,966,474 | 6/1976 | Harper | 427/68 |

*Primary Examiner*—John D. Smith
*Attorney, Agent, or Firm*—Craig & Antonelli

[57] ABSTRACT

In a process for producing a color television picture tube which comprises at least the step of coating phosphor slurries onto the inner surface of a panel to form a phosphor layer, the step of forming two layers each consisting of an aqueous filming emulsion containing an acrylic resin, the step of forming a metal film on the second layer, and the step of baking out the organic substances, a color television picture tube having a metal film which contains a few pores and cracks and no blister can be produced by using said phosphor slurries containing an acrylic resin and using the first aqueous filming emulsion containing an acrylic resin having an elongation of 10% or more and using the second aqueous filming emulsion containing an acrylic resin having an elongation of less than 10%.

5 Claims, 2 Drawing Figures

PROCESS FOR PRODUCING COLOR TELEVISION PICTURE TUBE

The present invention relates to a process for producing a color television picture tube. More particularly, the invention pertains to a process for producing a fluorescent screen of a color television picture tube.

In color television picture tubes, a color picture image is generally produced by projecting electron beams onto the fluorescent screen formed on the inner surface of a faceplate. Said fluorescent screen is usually formed according to the following process:

The first color (for example, green color) phosphor slurry is coated onto the inner surface of the faceplate panel by tilting and rotating the faceplate panel, etc. and then dried to form a slurry coating. The slurry coating is then exposed to light through a shadow mask having plurality of holes or slits. The shadow mask is then removed, warm water is sprayed, and development is carried out to form the first color phosphor picture element in the form of dot or stripe on the inner surface of the faceplate. In the same manner, the second color (for example, blue color) phosphor picture element and the third color (for example, red color) phosphor picture element are formed on the inner surface of the faceplate. FIG. 1 in the accompanying drawings shows a phosphor layer 2 comprising a group of phosphor picture elements formed on the inner surface of a faceplate 1 as described above. After the formation of the phosphor layer 2, the phosphor layer 2 is coated with an aqueous filming emulsion consisting mainly of an acrylic resin, heated and dried to form a resin film 3. Further, a metal film 4 as a metallic backing is formed thereon. After the formation of the metal film 4, baking step is carried out to volatilize the organic substances. Thus, a fluorescent screen is obtained.

In general, in order to improve the brightness of a color television picture tube, it is necessary to minimize pores and cracks in the phosphor layer 2 and the metal film 4. As a method for reducing the number of said pores and cracks, there is a method which comprises increasing the concentration of the resin in the aqueous filming emulsion for forming the resin film 3. When the number of the pores and cracks in the metal film 4 is reduced according to this method, however, blisters are formed in the metal film 4 in the baking step for volatilizing the resin film 3. Therefore, it is required for the metal film 4 to be rather porous.

An object of the present invention is to provide a process for producing a color television picture tube having a metal film which contains a few pores and cracks and no blister. Another object of the invention is to provide a process for producing a color television picture tube wherein the defects of prior art processes have been obviated.

Other objects and a fuller understanding of the invention will be had by referring to the following description and claims, taken in conjunction with the accompanying drawings in which:

According to the present invention, there is provided an improved process for producing a color television picture tube which comprises at least the step of coating phosphor slurries onto the inner surface of a panel to form a phosphor layer, the step of forming two layers each consisting of an aqueous filming emulsion containing an acrylic resin, the step of forming a metal film on the second layer, and the step of baking out the organic substances, characterized by using said phosphor slurries containing an acrylic resin and using the first aqueous filming emulsion containing an acrylic resin having an elongation of 10% or more and using the second aqueous filming emulsion containing an acrylic resin having an elongation of less than 10%.

The value of elongation used herein means the breakdown elongation of the acrylic resin sheet (10 mm in width, 50 mm in length, and 1 mm in thickness) as made by pressing powder of said acrylic resin at 180° C. and 100 kg/cm$^2$.

Figure 1:
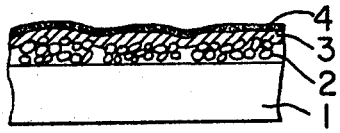
FIG. 1 is an explanatory drawing of a prior art process for the production of a color television picture tube.
Figure 2:
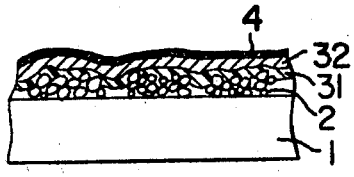
FIG. 2 is an explanatory drawing of a process for the production of a color television picture tube according to the present invention.

In the practice of the process of the present invention, as shown in FIG. 2, a phosphor slurry comprising a phosphor, polyvinyl alcohol, ammonium dichromate, an acrylic resin and a surface active agent is coated onto the inner surface of a faceplate 1, and exposure to light and development are then repeated to form a phosphor layer 2 comprising green, blue and red phosphor picture elements. In this case, the amount of the acrylic resin contained in the phosphor slurry is 10 to 300 parts by weight, and preferably 20 to 100 parts by weight, per 100 parts by weight of the polyvinyl alcohol (solid basis). A filming agent consisting mainly of an acrylic resin having an elongation of 10% or more, and preferably 40% or more, is then coated onto the phosphor layer 2, heated and dried to form the resin film 31 of the first layer. Another filming agent comprising an acrylic resin having an elongation of less than 10%, boric acid ester of polyvinyl alcohol, etc. is coated, heated and dried to form the resin film 32 of the second layer. A metal film 4 is then formed thereon. Baking out is conducted to volatilize the organic substances. The fluorescent screen formed according to such a process is good in that the metal film 4 contains few pores and cracks and no blister is caused.

The reasons therefor are as follows: First of all, the hydrophobic acrylic resin added to the phosphor slurry prevents the filming emulsion in the first layer from penetrating into the phosphor layer 2 and thereby the film-forming property of the filming emulsion of the first layer is improved and the occurrence of unevenness is prevented. Secondly, the acrylic resin as a component of the filming emulsion of the first layer decreases the occurrence of cracks in the phosphor layer 2 and prevents the metal particles from penetrating into the phosphor layer 2 on the formation of the metal film 4 by, for example, vapor deposition since the acrylic resin has a large elongation. Thirdly, the acrylic resin as a component of the filming emulsion of the second layer forms a porous resin film and can prevent the occurrence of blisters since the acrylic resin has a small elongation.

The following example illustrates the present invention in more detail.

EXAMPLE

A green phosphor slurry consisting of 30 parts by weight of a green phosphor (ZnS:CuAl), 2.2 parts by weight of polyvinyl alcohol, 0.22 part by weight of ammonium dichromate, 1.1 parts by weight of an acrylic resin "Primal C72" (manufactured by Nippon Acryl Co.), 0.05 part by weight of a surface active agent and 66.43 parts by weight of pure water is coated onto the inner surface of a faceplate by tilting and rotating the faceplate panel, heated by a heater and dried. A shadow mask is installed and the thus formed coating is exposed to light from a 2500 1x extra-high pressure mercury lamp at an appointed position through the shadow mask for 60 seconds and developed by spraying with warm water to obtain a green phosphor picture element. Then, blue and red phosphor picture elements containing an acrylic resin are formed by the use of a blue phosphor (ZnS:Ag) and a red phosphor ($Y_2O_2S$-:Eu) in the same manner. The phosphor layer is coated with a 6% aqueous emulsion of n-butyl methacrylate polymer (elongation 77%), heated by a heater and dried to form a resin film as the first layer. Another aqueous emulsion consisting of 15 parts by weight of an acrylic resin "Primal B74" (elongation 1.3%, manufactured by Nippon Acryl Co.), 0.5 part by weight of boric acid ester of polyvinyl alcohol, 0.5 part by weight of colloidal silica, 2 parts by weight of glycerol and 82 parts by weight of pure water is then coated and dried to form a resin film as the second layer. Aluminum is vapor-deposited thereon and the organic substances is volatilized by bakeout.

The fluorescent screen thus produced is very good in that the phosphor layer and the metal film contain few pores and cracks and no blister is caused. When a color television picture tube is assembled by the use of the fluorescent screen and a color picture image is produced, the brightness of the image is about 5% higher than the brightness of prior art color television picture tubes.

When the first layer acrylic resin film and the second layer acrylic resin film are formed without adding an acrylic resin to a phosphor slurry, it is found that remarkable radial unevenness of coating occurs.

As explained above, the process of the present invention is effective in that pores and cracks in the phosphor layer and the metal film can be diminished and the blistering of the metal film can be prevented.

What is claimed is:

1. In a process for producing a color television picture tube which comprises at least the step of coating phosphor slurries onto the inner surface of a panel to form a phosphor layer, the step of applying a first aqueous emulsion film containing an acrylic resin onto said phosphor layer and then drying the resulting coating film to form the first layer, then applying a second aqueous emulsion film containing an acrylic resin onto said first layer and then drying the resulting coating film to form the second layer, then the step of forming a metal film on the second layer, and then the step of volatilizing the organic substances in the layers, the improvement characterized by using phosphor slurries containing a hydrophobic acrylic resin and polyvinyl alcohol, the amount of the acrylic resin contained in each of said phosphor slurries is 10 to 300 parts by weight per 100 parts by weight of polyvinyl alcohol in the phosphor slurry, whereby the emulsion film forming the first layer is prevented from penetrating into the phosphor layer by the hydrophobic acrylic resin added to the phosphor slurry, using in the first aqueous emulsion film an acrylic resin having an elongation of 10% or more and using in the second aqueous emulsion film an acrylic resin having an elongation of less than 10%.

2. A process according to claim 1, wherein the amount of the acrylic resin contained in each of said phosphor slurries is 20 to 100 parts by weight of polyvinyl alcohol in that phosphor slurry.

3. A process according to claim 1, wherein the acrylic resin contained in the first aqueous filming emulsion has an elongation of 40% or more.

4. A process according to claim 1, wherein the step of coating phosphor slurries comprises coating three phosphor slurries onto the inner surface of the panel, each of these three slurries having a different phosphor, green, blue, and red phosphors, respectively, whereby a phosphor layer comprising green, blue, and red phosphor picture elements is formed.

5. In a process for producing a color television picture tube which comprises at least the step of coating phosphor slurries onto the inner surface of a panel to form a phosphor layer, the step of applying a first aqueous emulsion containing an acrylic resin onto said phosphor layer and then drying the resulting coating film to form the first layer, then applying a second aqueous emulsion film containing an acrylic resin onto said first layer and then drying the resulting coating film to form the second layer, then the step of forming a metal film on the second layer, and then the step of volatilizing the organic substances in the layers, the improvement characterized by using phosphor slurries containing an acrylic resin of a type and in an amount to prevent the first aqueous emulsion film from penetrating into the phosphor layer, using in the first aqueous emulsion film an acrylic resin having an elongation of 10% or more and using in the second aqueous emulsion film an acrylic resin having an elongation of less than 10%.

* * * * *